US009802244B2

(12) United States Patent
Seidel

(10) Patent No.: US 9,802,244 B2
(45) Date of Patent: Oct. 31, 2017

(54) METHOD FOR THE CONTINUOUS CASTING OF A METAL STRAND IN A CONTINUOUS CASTING INSTALLATION AND A CONTINUOUS CASTING INSTALLATION

(71) Applicant: SMS Siemag Aktiengesellschaft, Düsseldorf (DE)

(72) Inventor: Jürgen Seidel, Kreuztal (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 14/376,015

(22) PCT Filed: Jan. 31, 2013

(86) PCT No.: PCT/EP2013/051934

§ 371 (c)(1),
(2) Date: Jul. 31, 2014

(87) PCT Pub. No.: WO2013/113832

PCT Pub. Date: Aug. 8, 2013

(65) Prior Publication Data

US 2015/0000861 A1 Jan. 1, 2015

(30) Foreign Application Priority Data

Feb. 1, 2012 (DE) ..... 10 2012 201 395

(51) Int. Cl.
*B22D 11/12* (2006.01)
*B22D 11/128* (2006.01)
(Continued)

(52) U.S. Cl.
CPC ..... *B22D 11/1206* (2013.01); *B22D 11/1281* (2013.01); *B22D 11/1282* (2013.01);
(Continued)

(58) Field of Classification Search
CPC ... B22D 11/12; B22D 11/1206; B22D 11/128; B22D 11/1281; B22D 11/1282;
(Continued)

(56) References Cited

U.S. PATENT DOCUMENTS 3,344,648 A 10/1967 Gray
4,122,888 A 10/1978 Pühringer
(Continued)

FOREIGN PATENT DOCUMENTS

DE 1452102 12/1968
DE 7613430 X 12/1976
(Continued)

*Primary Examiner* — Kevin P Kerns
(74) *Attorney, Agent, or Firm* — Lucas & Mercanti, LLP; Klaus P. Stoffel

(57) ABSTRACT

A method for the continuous casting of a metal strand in a continuous casting installation, in which, in a casting machine, the metal formed into a slab, with a still molten core, is brought out vertically from a mold, wherein, downstream of the mold in the conveying direction, the slab is made to move along a casting bow, through a number of casting bow segments, and is deflected into the horizontal, wherein each casting bow segment has a number of segment rollers, which are designed for coming into contact with the surface of the slab. In the region before the end of the casting machine, a number of segment rollers are lifted off from the surface of the slab, or are not installed in receptacles provided, and so the contact between the slab and the segment roller is interrupted or there is no contact.

15 Claims, 6 Drawing Sheets

(51) Int. Cl.
*B22D 11/14* (2006.01)
*B22D 11/20* (2006.01)

(52) U.S. Cl.
CPC ..... *B22D 11/1287* (2013.01); *B22D 11/141* (2013.01); *B22D 11/145* (2013.01); *B22D 11/208* (2013.01)

(58) Field of Classification Search
CPC ... B22D 11/1287; B22D 11/14; B22D 11/141; B22D 11/208
USPC ..... 164/462, 423, 484, 442, 448
See application file for complete search history.

(56) References Cited

U.S. PATENT DOCUMENTS

| | | | | |
|---|---|---|---|---|
| 4,462,456 | A | 7/1984 | Kameyama et al. | |
| 5,219,114 | A * | 6/1993 | Kajiwara et al. | 228/158 |
| 7,980,291 | B2 | 7/2011 | Fest et al. | |
| 8,365,806 | B2 | 2/2013 | Rosenthal et al. | |
| 2005/0167076 | A1* | 8/2005 | Hennig et al. | B21B 1/46 164/476 |
| 2009/0139681 | A1 | 6/2009 | Seidel et al. | |
| 2009/0314457 | A1 | 12/2009 | Seidel | |

FOREIGN PATENT DOCUMENTS

| | | | | |
|---|---|---|---|---|
| DE | 3201417 | | 8/1982 | |
| DE | 102010022003 | A | 12/2010 | |
| EP | 0005340 | B1 | 1/1983 | |
| EP | 0042656 | B1 | 8/1984 | |
| EP | 0287021 | A | 10/1988 | |
| EP | 0198595 | B1 | 5/1990 | |
| GB | 1603428 | A | 11/1981 | |
| JP | 57-79056 | A * | 5/1982 | B22D 11/128 |
| JP | 62222015 | | 9/1987 | |
| WO | 2007073841 | A | 7/2007 | |
| WO | 2007137759 | A | 12/2007 | |
| WO | 2008/025325 | | 3/2008 | |

* cited by examiner

METHOD FOR THE CONTINUOUS CASTING OF A METAL STRAND IN A CONTINUOUS CASTING INSTALLATION AND A CONTINUOUS CASTING INSTALLATION

The present application is a 371 of International application PCT/EP2013/051934, filed Jan. 31, 2013, which claims priority of DE 10 2012 201 395.4, filed Feb. 1, 2012, the priority of these applications is hereby claimed and these applications are incorporated herein by reference.

BACKGROUND OF THE INVENTION

The invention pertains to a method for the continuous casting of a metal strand in a continuous casting installation, in which the metal, which has been formed into a slab with a still molten core in a casting machine, is brought vertically out of a mold, wherein the slab is guided downstream of the mold in the conveying direction through a number of segments, wherein each segment comprises a number of segment rollers, which are configured to make contact with the surface of the slab, and wherein, in the area upstream of the end of the casting machine, a number of segment rollers are raised from the surface of the slab or are not installed in the mountings provided, so that the contact between the slab and the segment rollers is interrupted or not present. The invention also pertains to a continuous casting installation.

The production of a strand by a method of the class in question is sufficiently well known from the prior art. The cast strand, that is, the slab, leaves the mold with a core which is still in the molten state. Along the curved apron, the slab is deflected from the vertical to the horizontal, for which purpose a number of apron segments are used. Each segment of the curved apron has a number of segment rollers, which are arranged in pairs to contact the slab on opposite sides.

With respect to the prior art, reference is made to FIGS. 1-3. FIG. 1 shows a side view of a casting machine forming one component of a continuous casting installation. FIG. 2 shows the change in temperature between the mold and a furnace, located downstream of the casting machine.

It can be seen in FIG. 1 that the continuous casting installation 1 comprises the casting machine 2, which has a number—eight being shown in the present case—of apron segments 4, 5, 6, 7, 8, 9, 10, and 11, which form a curved apron 3. The mold and the first three apron segments are not shown. Along the curved apron 3, the cast slab is conveyed in the conveying direction F to the end 14 of the casting machine, during which process it is deflected from the vertical to the horizontal.

A number of pairs of segment rollers 12, 13 are supported in each apron segment 4, 5, 6, 7, 8, 9, 10, 11; the slab is conveyed between each pair.

The length of the casting machine (from the mold to the end 14 of the casting machine) is usually determined in such a way that, at maximum mass flow (corresponding to the thickness or cross section of the slab times the casting speed), the solidification of the cast strand occurs while the strand is still within the last apron segment (i.e., in the present case, in apron segment 11). The temperature curve resulting from this is shown in FIG. 2, based on the example of a 16.4-m-long curved apron installation. Shown are the core temperature $T_K$, the surface temperature $T_O$ (on the bottom of the slab), and the mean value of the temperature $T_M$ over the slab thickness as the slab passes through the casting machine and reaches the downstream roller hearth furnace. The end 14 of the casting machine and the entrance 19 of the furnace are indicated.

The average outlet temperature of the thin slab emerging from the casting machine is greater than 1,200° C. in this case. As it travels toward the furnace, the slab loses another 70° C. or so to the free surroundings and to the rollers, etc. As a result of the high mass flow, however, the temperature level at the entrance to the furnace is still sufficiently high (here: 1,166° C.).

It should be mentioned that the complete solidification of the slab occurs shortly before the end 14 of the casting machine; this point is designated by the number 23.

The continuous casting installation, however, is not always operated under optimal conditions or at maximum casting speed. Depending on the product to be cast, furthermore, slower casting speeds may be required for reasons of casting technology (e.g., surface quality, crack prevention, casting stability). It can and must be possible to adjust the casting speed of the casting machine flexibly. Again for reasons of casting technology, however, the cooling of the strand cannot be adapted however one might wish to a lower mass flow. At lower mass flows, the casting strand therefore solidifies a good distance before the end of the continuous casting installation, as can be seen in FIG. 3. Here, again, the change in the temperature between the mold and the furnace is shown, but now at a slower casting speed in comparison to FIG. 2. The point at which the slab solidifies is again designated by the number 23 and is situated far upstream of the end 14 of the casting machine. After complete solidification, the strand loses an additional 150° C. or so in this example (see $\Delta T_1$) as it travels onward through the continuous casting installation before reaching the end 14 of the casting machine. Because of the low mass flow, the temperature loss between the end of the continuous casting machine 14 and the entrance 19 to the furnace is relatively high also (see $\Delta T_2$: approximately 100° C. in this example), so that, in the present case, the average temperature on entry into the furnace is often only about 987° C.

At a low mass flow, therefore, the slab loses a considerable amount of energy and solidifies quickly within the continuous casting installation as it is being transported to the furnace.

A method of the type indicated above is known from DE 76 13 430 U1. Additional solutions are disclosed in GB 1 603 428 A; WO 2007/137759 A1; WO 2007/073841A1; DE 10 2010 022 003 A1; and EP 0 287 021 A2.

SUMMARY OF THE INVENTION

The invention is based on the goal of proposing a method and a continuous casting installation which makes it possible to lower the energy losses mentioned above in a simple and efficient manner, so that it is always possible to maintain optimal process conditions even when the casting speed is changed. An energy-optimized operating method is therefore to be made possible, which can be implemented for any given casting speed.

With respect to the method, the achievement of this goal by the invention is characterized in that a thermal insulating element is introduced between the slab surface and the at least one segment roller which has been raised from the slab or has not been installed. It is preferably provided that, downstream from the mold in the conveying direction, the slab is guided along a curved apron through a number of apron segments and deflected into a horizontal plane, wherein each apron segment comprises a number of segment rollers, which are configured to make contact with the surface of the slab, and wherein, along the curved apron, in the area of the end of the casting machine, a number of segment rollers are raised from the surface of the slab or are not installed in the mountings provided.

This introduction of the insulating element can be achieved by inserting it horizontally from the side of the slab.

Thermal insulating elements can be permanently installed between support rollers or drive rollers, which are spaced a certain distance apart, especially in front of one or both sides or edges of the slab.

A numerical simulation is preferably carried out by means of a mathematical model, wherein the position of the tip of the liquid crater is determined at least on the basis of the casting speed and the slab geometry but also in certain cases on the basis of additional parameters, wherein the raising of the segment rollers proceeds on the basis of the numerical simulation in such a way that the raising applies to a defined section of the curved apron. In concrete terms, the apron segments located downstream of the calculated tip of the crater can be raised and possibly provided with thermal insulating elements.

The segments of the curved apron are usually provided with coolants to cool the slab, wherein, in this case, the cooling action can be reduced or even decreased to zero in at least a certain number of the apron segments.

The slab can be supported, at least in the area of the apron segments with raised segment rolls, by preferably driven support rolls, so that, even though the support rolls no longer have contact, it is still ensured that the slab will have sufficient guidance and will be transported effectively. Alternatively, pairs of drive rolls or clamping rolls can be installed at certain intervals.

The raised segment rolls and/or the support rolls exposed to the radiant heat of the slab are preferably driven in rotation.

The proposed insulating effect in the continuous casting installation is preferably combined with or supplemented by insulating measures implemented downstream from the continuous casting installation.

A furnace—in addition to other units—is usually installed downstream from the casting machine, wherein at least one thermal insulating element for the thermal insulation of the slab can be arranged in the area between the end of the casting machine and the entrance to the furnace. In this case, it is possible to provide that the at least one thermal insulating element is moved only temporarily into the area of the slab to provide thermal insulation.

It is also preferably provided that the at least one thermal insulating element is moved into the area of a shears and/or into the area of an in-line stand and/or into the area of a cold strand removal unit.

By the use of insulating elements in the continuous casting installation and/or downstream of the continuous casting installation, it is thus possible to improve the material properties—including those on the surface and at the edges of the slab—by increasing the minimum temperature upstream of the reheating in the furnace (or in the induction heating unit).

The proposed continuous casting installation for the continuous casting of a metal strand, which installation comprises a casting machine in which the metal formed into a slab with a still molten core can be brought vertically out of a mold, wherein a curved apron with a number of segments is arranged downstream in the conveying direction from the mold, by means of which apron the slab can be deflected into a horizontal plane, and wherein each apron segment comprises a number of segment rolls, which are configured to make contact with the surface of the slab, is characterized according to the invention in that, along the curved apron, in the area upstream from the end of the casting machine, a number of segment rolls are provided with positioning means so that the segment rolls can be raised from the surface of the slab, wherein at least one movable thermal insulating element is present, which can be placed in a passive position outside the apron segment and in an active position inside the apron segment and between the raised segment rolls and the slab.

The at least one movable thermal insulating element can be adjustably arranged by the positioning means horizontally and transversely to the conveying direction of the slab.

The thermal insulating elements used are known as such from the prior art. Use can be made of these solutions. Reference is made in particular to EP 0 198 595 B1, to EP 0 005 340 B1, to DE 1 452 102 A1, and to EP 0 042 656 B1.

With the proposed method, the temperature of the slab downstream from the casting machine is increased, and a higher furnace entry temperature is achieved without the need for any additional energy.

To reduce the effort required to reheat the slab in the furnace and thus to save on energy costs, therefore, the following measures are proposed in the area of the continuous casting installation (including the following transport route to the furnace):

When necessary, that is, when the degree to which the solidified slab cools or cools down is to be reduced, the segment rolls should be raised from the strand; that is, the rolls in the segments in which the strand has already solidified completely should be raised. As a result, the cooling contact of the rolls, which has the effect of cooling the strand, is avoided. To avoid the one-sided heating and deformation of the rolls, it is advisable for the rolls to be driven. This is true especially in cases where the rolls are exposed to the radiant heat of the slab for prolonged periods without protection, that is, without insulation.

If the segment rolls are raised even farther from the strand, it is possible to insert an insulating hood (thermal insulating element) between the strand and the segment rolls. The insulating hood heats up in continuous use to approximately the same temperature as that present at the surface of the strand and thus significantly reduces the loss of temperature.

The strand in this case is supported only by individual, preferably driven, strand rolls (support rolls).

In the continuous casting installation, the segment cooling is minimized within the scope of the technologically allowable limits in the area extending from the mold to the point of complete solidification of the strand. It is effective to use a two-component cooling approach, which offers a larger range over which the cooling action can be adjusted; dry casting is also possible, however, at least under certain conditions.

Another measure is to deactivate the segment cooling in the area extending from the completely solidified part of the strand to the end of the casting machine.

A mathematical model is preferably used to control the method. This mathematical model describes the cooling of the strand within the continuous casting installation and identifies the segment in which the strand can be reliably expected to solidify. The mathematical model takes the following parameters into account, among others:

casting speed, slab thickness or slab geometry, material constants, settings used during cooling in the mold, the cooling action of the segment cooling, the cooling action attributable to the segment rolls and to the rest of the surroundings.

The calculation can take place as a "setup" step prior to the start of casting, or it can be carried out dynamically during the casting process. The segments which are to be raised are determined on the basis of the simulation. If the mass flow changes during casting, individual segments can be raised or lowered back down again, so that the length of the strand can be changed flexibly.

It is possible to adjust a complete segment as described; as an alternative, it is also possible to adjust groups of segments or even separate, individual segment rolls or pairs of segment rolls.

Between the casting machine and the following furnace, the following measures can have an advantageous effect on the achievement of the goal according to the invention and can be used to supplement the desired effect:

Every free area can be provided with stationary or movable insulating hoods (thermal insulating elements).

This can be done first in the area where the cold strand is removed. For this purpose, after the cold strand has been removed, the boom is swung up and away, and an insulating hood is introduced into the free space.

Similar thermal insulation is also possible between the rolls of the roller tables.

In the same way, thermal insulation can also be provided in the area of the shears frame and the shear blades. To allow cutting, the thermal insulation hoods can be swung out of the cutting area and then swung back into place after cutting. Accordingly, no insulation is possible in this area at the leading and trailing ends of the slab. These temperature losses or temperature differences, however, can be compensated in the furnace by carefully planned operation of the burners or more efficiently by a small induction heating unit, which acts on these colder areas.

The temperature differences at the trailing end of the slab are compensated almost completely by transporting the slab into the furnace rapidly.

Thermal insulation is also possible in the slab cleaning area. This area is available when the slab cleaner is not being used and has been swung up and out of the way.

It is also advantageous to minimize the distance between the end of the casting machine and the entrance to the furnace.

The proposed measures are used preferably in a thin-slab, continuous casting installation with a curved apron. Of course, they are also suitable for other types of continuous casting installations, especially for vertical casting installations and for conventional thick-slab casting installations.

In a vertical continuous casting installation, appropriate insulating measures are preferably provided in the first vertical and curved areas downstream from the continuous casting installation.

Instead of a shears and a furnace downstream from the casting machine, it is also possible to install an in-line rolling stand downstream from the casting machine, followed by a shears and then a furnace (or inductive heating unit). The same insulating measures as those described above apply also to the area of the in-line rolling stand.

With the proposed method and configuration of the apparatus, it is possible to achieve the following energy-related advantages:

There is only a minimal temperature loss in the area of the casting machine and along the downstream transport route. The amount of energy required to heat the following furnace (usually a conventional roller hearth furnace) is reduced.

If, as a result, the temperature of the slab at the entrance to the furnace is 100° C. higher than it would have been otherwise, a savings of approximately 36 kWhr/ton of gas energy in the furnace is achieved, that is, approximately €1.10/ton at a gas price of €0.03/kWhr.

That a higher furnace entry temperature can be obtained is advantageous both in terms of the mean energy value and the value at the surface of the slab and especially at its edges.

Especially in the case of the higher-grade materials, it is possible to improve and to guarantee the material properties even at the low mass flows which may be necessary for technological reasons.

The wear of the segment rolls is also reduced by the proposed measures, especially in the rear part of the casting machine.

As a consequence of the higher average furnace entry temperature, it is also possible to reduce the length of the furnace somewhat.

Finally, the load on the shears is decreased, or a smaller shears can be configured.

The drawing shows exemplary embodiments of the invention:

DETAILED DESCRIPTION OF THE INVENTION

Figure 1:
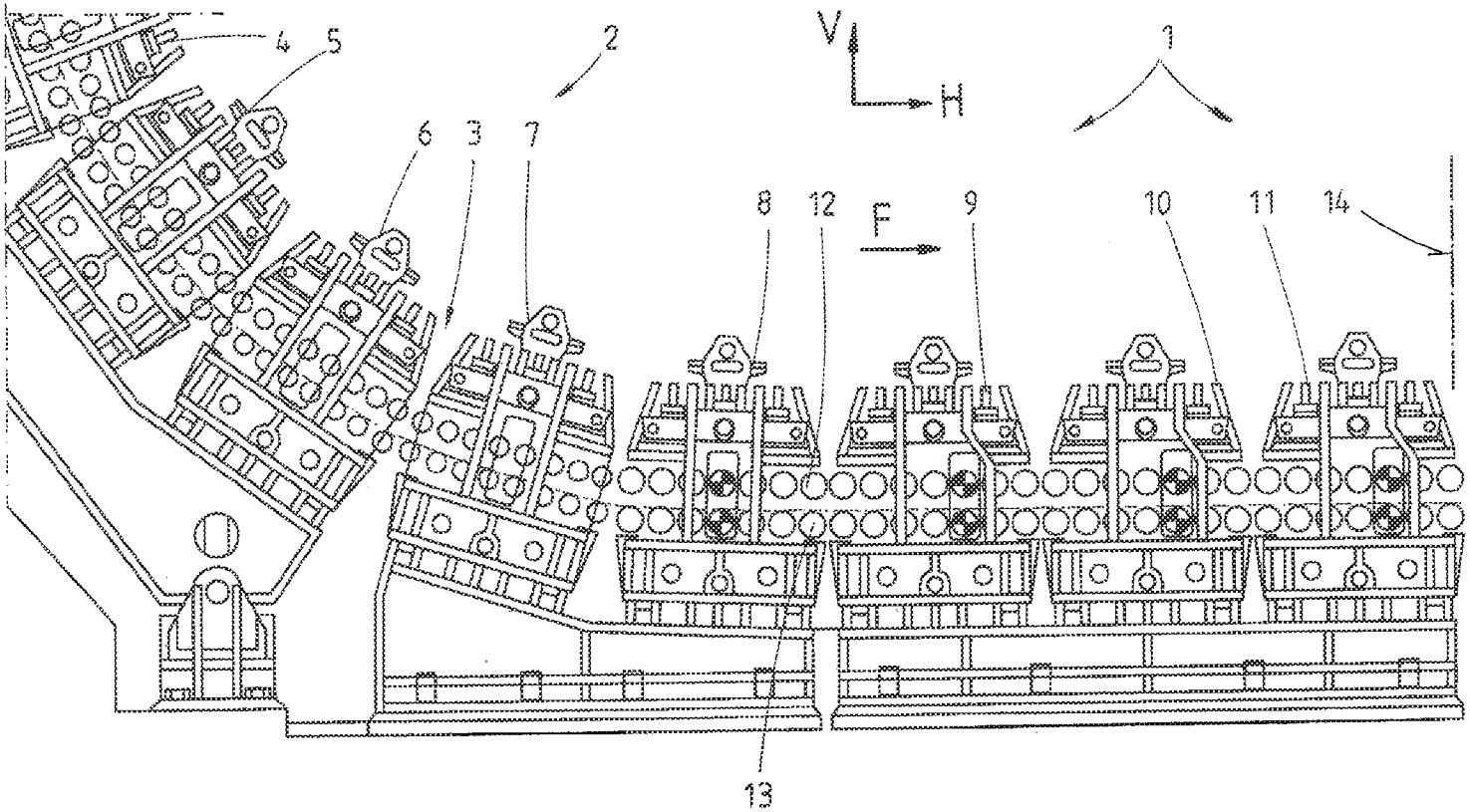
FIG. 1 PRIOR ART
FIG. 1 shows a side view of a casting machine forming a component of a continuous casting installation according to the prior art.
Figure 2:
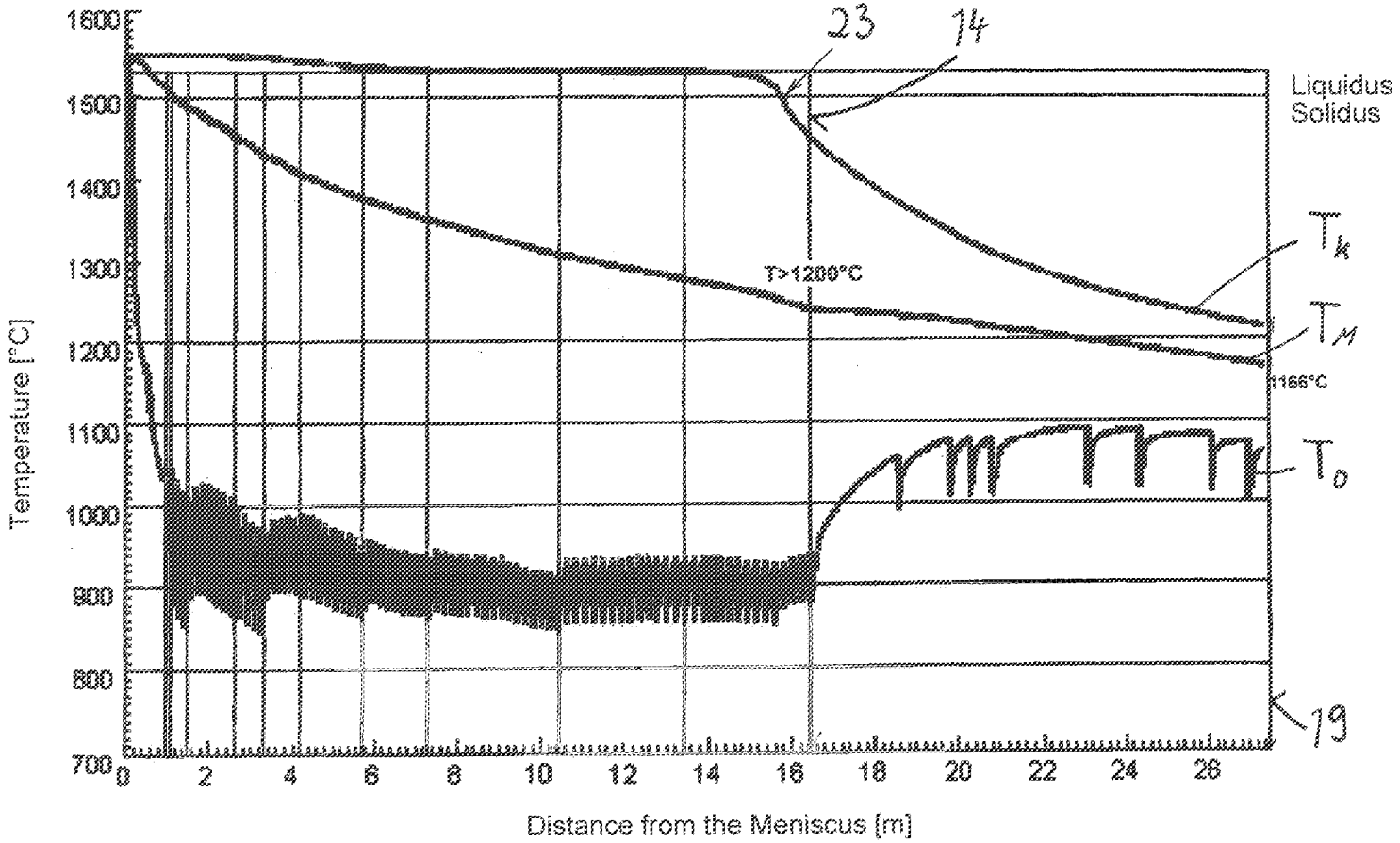
FIG. 2 PRIOR ART
FIG. 2 shows the change in temperature according to the prior art between the mold and a furnace installed downstream from the casting machine, wherein a first, high casting speed is being used.
Figure 3:
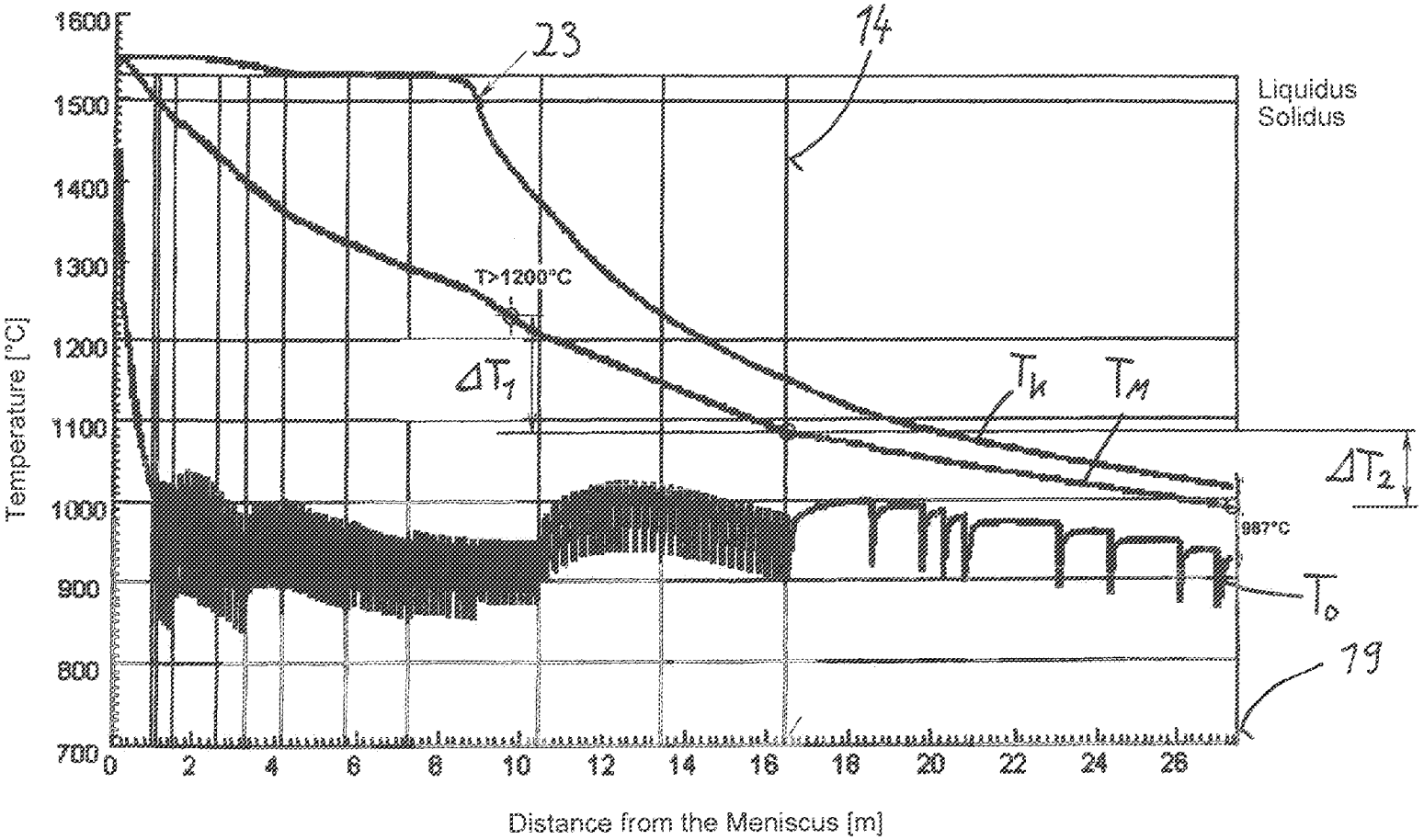
FIG. 3 PRIOR ART
FIG. 3 shows the change in temperature according to the prior art between the mold and the downstream furnace, wherein a second, reduced casting speed is being used.
Figure 4:
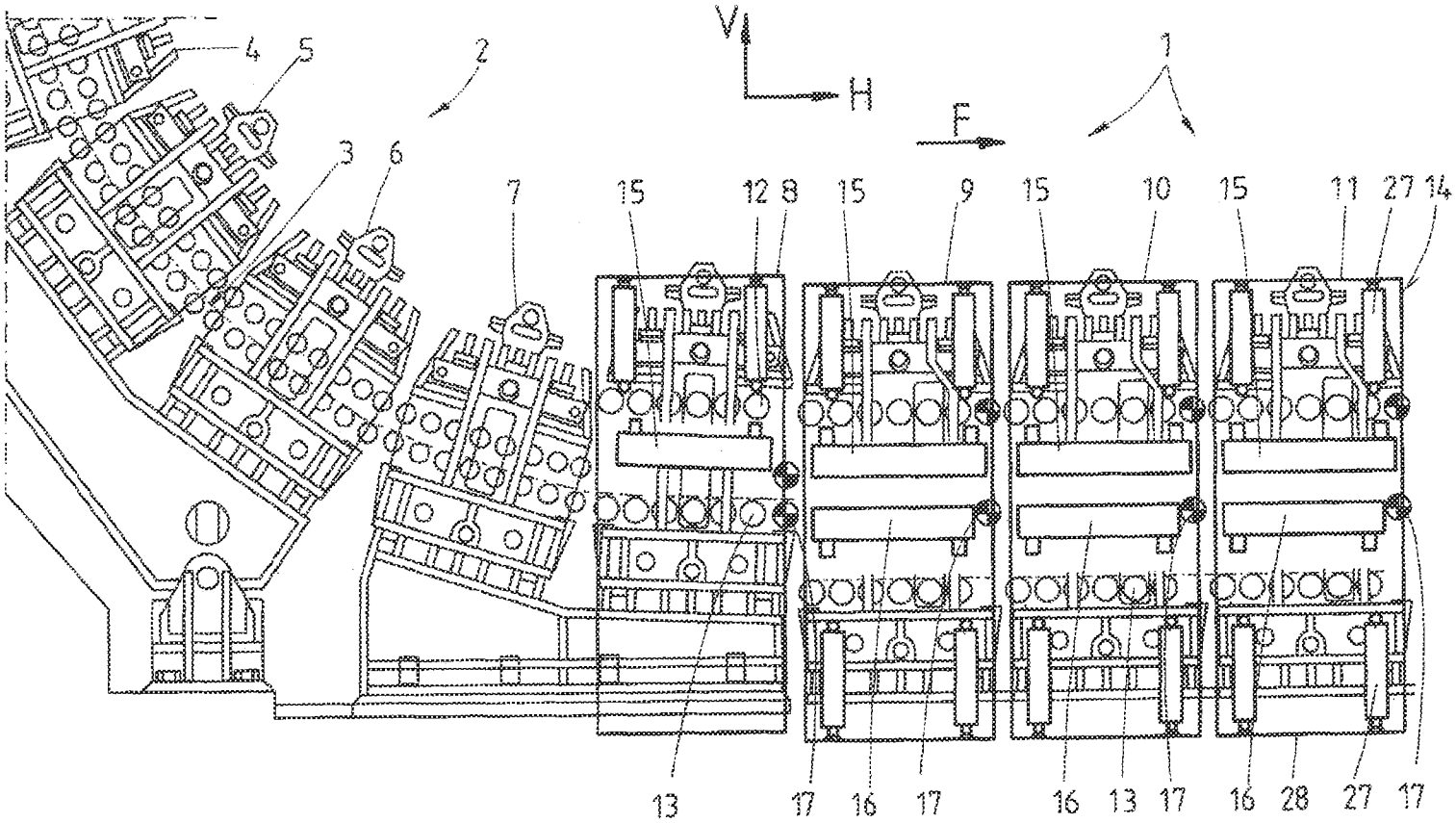
FIG. 4 shows a side view of the casting machine, which is now equipped and operating according to the invention.

FIG. 4 represents a continuous casting installation 1, wherein the casting machine 2 is shown. Concerning the structure and manner of operation of the machine, reference is made to the above discussion of FIG. 1, which applies analogously here. The new element here is that work is carried out at a casting speed which has been reduced to such an extent that, unless additional measures are taken, the tip of the molten crater is no longer situated in the area of the end 14 of the casting machine but rather—as illustrated in FIG. 3—in the middle area of the casting machine. This would have negative consequences, as discussed above in conjunction with FIG. 3.

To prevent this, it is now provided according to the invention that, along the curved apron 3, a number of segment rolls 12 and 13 are raised from the surface of the slab. The contact between the segment rolls and the slab is thus interrupted. This has the effect per se that the cooling action produced by the surface contact between the segment rolls and the slab is no longer present, and the slab therefore cools down to a lesser extent as it travels toward the end 14 of the casting machine.

The segment rolls, furthermore, are raised or lowered in the direction perpendicular to the surface of the slab to such an extent that a thermal insulating element 15, 16 can be introduced between the slab surface and the segment rolls 12, 13 which have been raised from the slab. Said insulating elements 15, 16 have been pushed laterally, in the horizontal direction, into the intermediate space created between the slab and the segment rolls 12, 13.

The result is that the slab now cools down to a much lesser extent that it would in the absence of the measure just described.

To continue to provide the slab with adequate guidance in spite of the raising or lowering of the segment rolls 12, 13, preferably driven support rolls 17 are arranged in the segments of the curved apron. The strand will therefore be supported by only a few support rolls 17. In the exemplary embodiment according to FIG. 4, the last three or four curved apron segments 8, 9, 10, 11 have been set up in this way.

In the present case, as will be seen again later in conjunction with FIG. 6, the cast strand has already solidified completely in the area of the curved apron segment 7. The following curved apron segments 8, 9, 10, and 11, therefore, are opened up and provided with insulating elements 15, 16. These measures can be carried out above and below the slab, but it is also possible to carry them out on only one side.

Lateral insulation along the edges of the slab is also provided. This insulation can be attached to the insulating elements 15, 16, or it can have its own positioning mechanisms. This lateral insulation is not, however, shown in FIG. 4.

The increased extent to which the segment rolls are raised or lowered can be carried out by means of, for example, long-stroke hydraulic cylinders 27, which, in the exemplary embodiment according to FIG. 4, are mounted on the frames 28. It is also possible to use mechanical adjusting devices or pneumatic cylinders as positioning elements.

When the casting conditions are set up so that one or more casting segments or segment areas are not being used for a considerable period of time, it can be advantageous, as an option, to prepare these casting segments in such a way that the insulating elements are mounted permanently in position. Here, too, as shown in FIG. 4, the cast strand is supported by support or drive rolls spaced a certain distance apart, and stationary insulation is built into the areas in between, at the top and/or at the bottom, and possibly also along the side edges. In this case, therefore, there is no longer any need to move the insulation in and out. In addition, there is no need to move the segment rolls a considerable distance away from or back toward the slab, or the segment rolls can simply not be installed in the insulated area from the very beginning.

Figure 5:
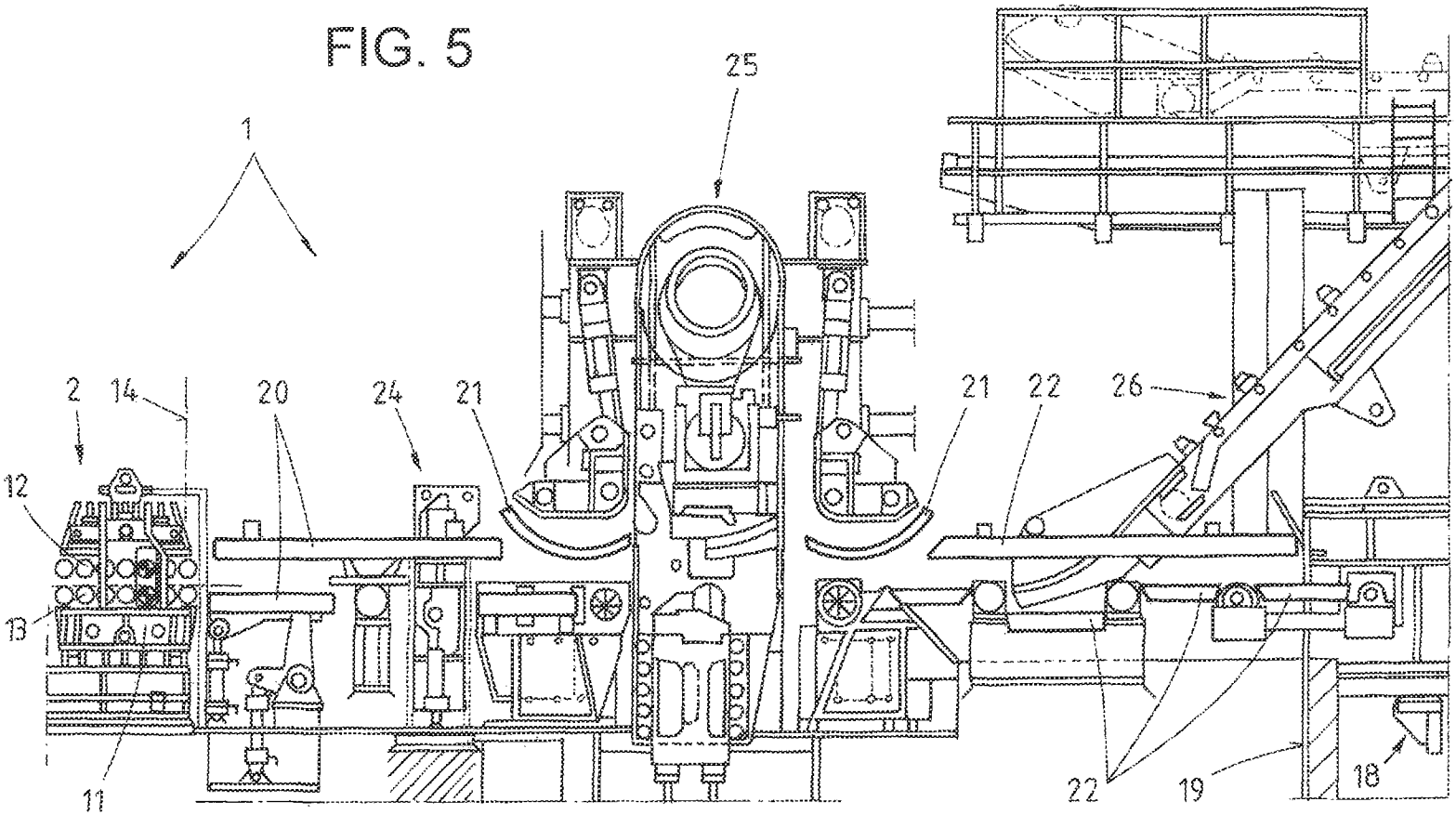
FIG. 5 shows the area of the continuous casting installation between the end of the casting machine and the furnace, which is equipped and operating according to the invention.

In FIG. 5 it can be seen that thermal insulation measures are also implemented in the area between the end 14 of the casting machine and the entrance 19 to the following furnace 18 in order to keep the slab hot on its way to the furnace. Thermal insulating elements 20, 21, and 22 are provided, which, like the thermal insulating elements 15 and 16, block the transfer of heat from the slab to the surroundings and thus ensure that the slab remains hot.

In the area of the slab cleaning unit 24, a swingable insulating hood 20 is provided. The hood can be swung into position when the spray beam of the slab cleaning unit 24 is not active and has been swung up and out of the away.

Thermal insulating elements 21 are also present in the area of the shears 25. The arrows at the insulating elements 21 show the directions in which the insulating elements 21 are swung, either into their active position (in which they insulate) or into their passive position (to allow the slab to be cut).

A thermal insulating element 22 is also present in the area of the cold strand removal unit, directly in front of the furnace 18. The boom 26 for removing the cold strand is indicated. After the cold strand has been removed, the upper insulating element 22 can be swung into the position shown. The lower thermal insulating elements are, in the present case, configured as permanent insulation.

These measures supplement the insulating effect in the continuous casting installation. Without insulating elements downstream from the continuous casting installation, some of the temperature effect generated by the continuous casting installation would be lost.

Figure 6:
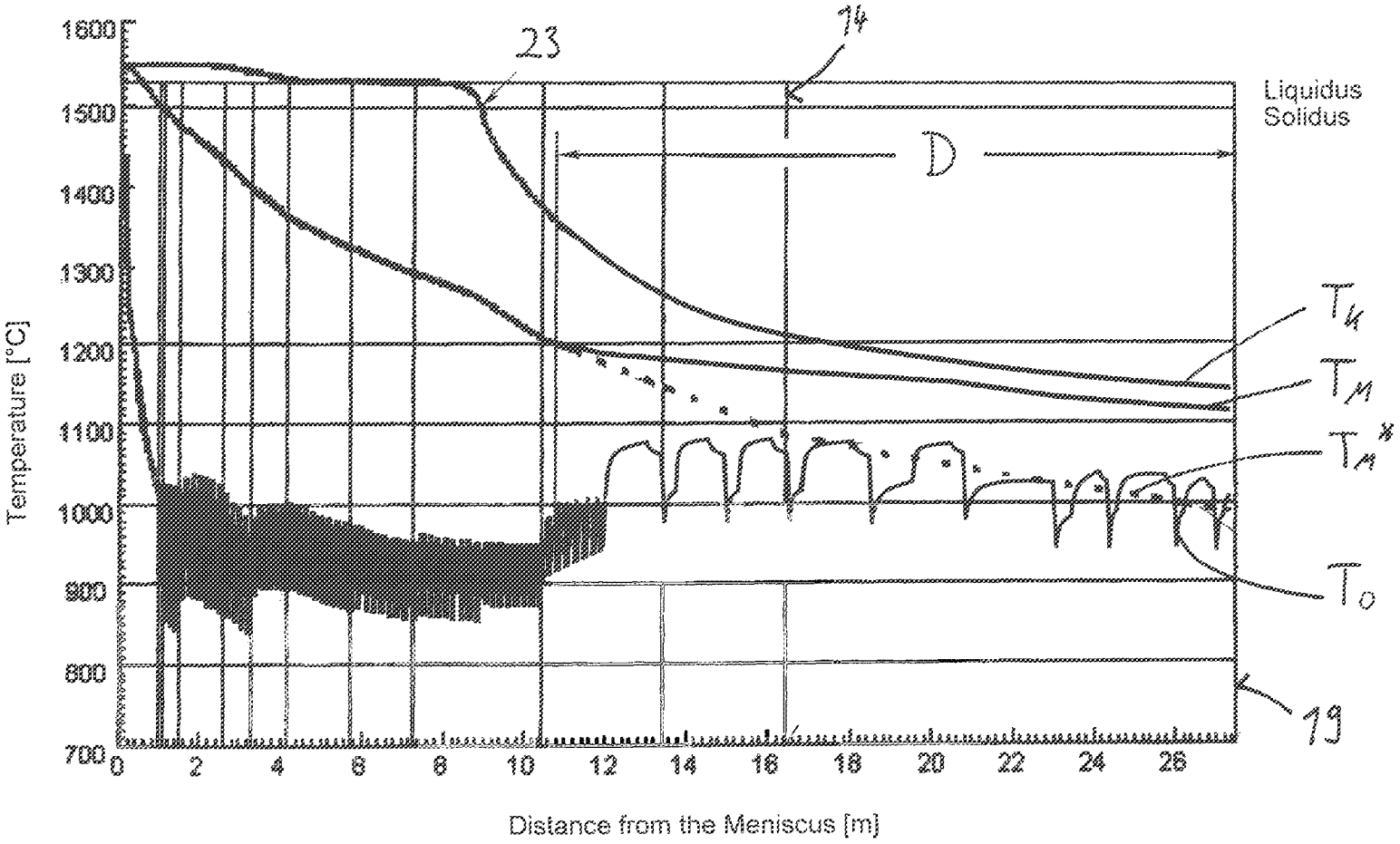
FIG. 6 shows the change in temperature between the mold and the downstream furnace, wherein the second, reduced casting speed and the method according to the invention is being used.

In FIG. 6 it can be seen how the temperature of the slab changes when the configuration and operating method according to the invention are used.

The resulting temperature curves for the core temperature $T_K$, the mean temperature of the slab $T_M$, and the mean surface temperature $T_O$ on the bottom of the slab are again indicated, wherein, in addition, for the purpose of comparison, the mean value of the temperature $T_M$* is entered in dotted line, which shows the change which would have occurred without the measures according to the invention. That the curve $T_M$ on a higher temperature level is obtained instead of the curve $T_M$* is therefore the result of the circumstance that the previously described thermal insulation measures were carried out in the area labeled D.

Accordingly, even though no additional energy has been consumed, the slab has a higher temperature at the entrance to the furnace 18.

In the proposed continuous casting installation in which the segment rolls are raised to an increased extent, the support lengths (frames) and the strokes of the positioning elements, etc., are increased as well. To optimize the accuracy with which the segment rolls are adjusted, a mathematical model and/or a control algorithm is used, which describes the stiffness of the segment and of the segment frame and the influence of the positioning elements (e.g., oil columns) as a function of the contact pressure and the thermal changes in the mechanical components (rolls, frames). Alternatively or in addition, it would also be possible to use force and position sensors.

In the continuous casting installation according to the invention, furthermore, some of the segments do not have one fixed and one loose side; instead, both sides are adjustable. When the segments are opened and closed, the sides are positioned by means of position sensors or optionally moved by the positioning elements against stops (distance limits, simulating a fixed side), which thus define the position setting.

The modified structure of the segments can also have an effect on the procedure for replacing the segments. When segment replacement is called for, the segments can be replaced together with the frames 28 and the positioning elements 27; or the frame 28 can represent a permanent structure, and, after removal of the transverse beams, the segment rolls are removed for replacement.

For replacement, the segments or parts of segments can be removed laterally through the frame, transversely to the slab transport direction, or they can be raised vertically, perpendicular to the slab transport direction.

LIST OF REFERENCE SYMBOLS

1 continuous casting installation
2 casting machine
3 curved apron
4 segment/curved apron segment
5 segment/curved apron segment
6 segment/curved apron segment
7 segment/curved apron segment
8 segment/curved apron segment
9 segment/curved apron segment
10 segment/curved apron segment
11 segment/curved apron segment
12 segment roll
13 segment roll
14 end of the casting machine
15 thermal insulating element
16 thermal insulating element
17 support roll
18 furnace
19 furnace entrance
20 thermal insulating element
21 thermal insulating element
22 thermal insulating element
23 point of complete solidification
24 slab cleaner
25 shears
26 cold strand removal boom
27 positioning element (hydraulic cylinder)
28 frame
V vertical
H horizontal
F conveying direction
$T_K$ core temperature
$T_O$ surface temperature (on bottom of the slab)
$T_M$ mean value of the temperature
$T_M$* mean value of the temperature without thermal insulation measures
D area of the thermal insulation measures

The invention claimed is:

1. A method for continuous casting of a metal strand in a continuous casting installation, comprising the steps of: bringing a metal, which has been formed into a slab with a still-molten core in a casting machine, vertically out of a mold; guiding the slab downstream of a mold in a conveying direction through a number of segments and deflecting the slab into a horizontal plane, wherein each segment comprises a number of rollers on each side of the slab, which rollers are configured to make contact with a surface of the slab; raising a number of the rollers from the surface of the slab on the side of the slab that faces upward when the slab is in the horizontal plane or not installing the rollers in mountings provided in an area upstream of an end of the casting machine, so that contact between the slab and the raised rollers is interrupted or is not present; and introducing a thermal insulating element between the surface of the slab and a surface of the raised or not installed rollers, which roller surface is closest to the slab surface.

2. The method according to claim 1, wherein, downstream of the mold in the conveying direction, the slab is guided along a curved apron through a number of curved apron segments and deflected into a horizontal plane, wherein each curved apron segment comprises a number of segment rollers, which are configured to make contact with the surface of the slab, wherein, along the curved apron in the area upstream of the end of the casting machine, a number of segment rollers are raised from the surface of the slab or not installed in the mountings provided.

3. The method according to claim 2, further including carrying out a numerical simulation pursuant to a mathematical model, wherein a location of a tip of the molten core is determined at least based on casting speed and slab geometry, wherein raising of the segment rollers is carried out on the basis of the numerical simulation so that the raising is carried out for a defined section along the segments.

4. The method according to claim 3, wherein the raising is carried out along the curved apron.

5. The method according to claim 1, wherein introduction of the insulating element is accomplished by inserting the insulating element horizontally from a side of the slab.

6. The method according to claim 1, wherein the thermal insulating element is permanently installed between support rollers or drive rollers, which are spaced a certain distance apart in front of one or both sides or edges of the slab.

7. The method according to claim 1, further including providing the segments with coolant to cool the slab, wherein cooling action is reduced or decreased to zero at least in a number of segments.

8. The method according to claim 1, wherein the slab is supported by support rollers at least in an area of the segments with raised segment rollers.

9. The method according to claim 1, wherein the raised segment rollers and/or support rollers exposed to radiant heat of the slab are driven in rotation.

10. The method according to claim 1, including arranging a furnace downstream from the casting machine, and arranging at least one thermal insulating element for thermally insulating the slab in an area between the end of the casting machine and the furnace entrance.

11. The method according to claim 10, wherein the at least one thermal insulating element is moved only temporarily into the area of the slab to thermally insulate the slab.

12. The method according to claim 11, wherein the at least one thermal insulating element is moved into an area of a shears and/or into an area of an in-line stand and/or into an area of a cold strand removal unit.

13. A continuous casting installation for continuous casting of a metal strand, comprising: a casting machine, in which a metal which has been formed into a slab with a still molten core is brought vertically out of a mold; a number of segments arranged downstream from the mold in a conveying direction to deflect the slab into a horizontal plane, wherein each segment comprises a number of rollers on each side of the slab, which rollers are configured to make contact with a surface of the slab, wherein in an area upstream of an end of the casting machine, a number of the rollers are provided with positioning means to allow the rollers to be raised from the surface of the slab on the side of the slab that faces upward when the slab is in the horizontal plane; and, at least one movable thermal insulating element placeable in a passive position outside the segment and in an active position inside the segment and between the slab surface and a surface, which is closest to the slab surface, of the raised rollers.

14. The continuous casting installation according to claim 13, wherein, downstream from the mold in the conveying direction, a curved apron with a number of apron segments is arranged, by which the slab is deflected into a horizontal plane, wherein a number of the segment rollers extending along the curved apron in the area upstream of the end of the casting machine are provided with the positioning means to allow the segment rollers to be raised from the surface of the slab.

15. The continuous casting installation according to claim 13, wherein the at least one movable thermal insulating element is adjustably arranged so as to be positionable horizontally and transversely to the conveying direction of the slab.

* * * * *